United States Patent [19]

Menchetti et al.

[11] Patent Number: 4,514,945

[45] Date of Patent: May 7, 1985

[54] WINDOW INSULATING SYSTEM

[75] Inventors: Robert J. Menchetti, Kenmore; Gale E. Sauer, Williamsville, both of N.Y.

[73] Assignee: Donn Incorporated, Westlake, Ohio

[21] Appl. No.: 276,469

[22] Filed: Jun. 23, 1981

[51] Int. Cl.[3] ..... E06B 3/26; E06B 3/28

[52] U.S. Cl. ..... 52/202; 52/203; 52/455; 52/580; 52/780

[58] Field of Search ..... 52/202, 206, 235, 241, 52/476, 397, 400, 772, 208, 127.6, 127.8, 238, 475, 488, 788, 785, 823, 809, 826, 579, 582, 308, 789, 791, 580, 780, 781, 203, 455, 456; 49/463, 464, 466, 125, 61, 488

[56] References Cited

U.S. PATENT DOCUMENTS

| | | | |
|---|---|---|---|
| 1,717,740 | 6/1929 | Simon | 52/781 |
| 2,743,980 | 5/1956 | Hobbs | 52/823 |
| 3,071,215 | 1/1963 | Gall | 52/456 X |
| 3,214,879 | 11/1965 | Elhngson, Jr. et al. | 52/202 X |
| 3,358,411 | 12/1967 | Birum | 52/241 |
| 3,381,416 | 5/1968 | De Torres et al. | 49/464 |
| 3,555,755 | 1/1971 | Reed | 52/308 |
| 3,561,183 | 2/1971 | Keener | 52/488 |
| 3,824,753 | 7/1974 | Anderson | 49/62 |
| 4,044,812 | 8/1977 | Swanstrom | 160/206 |
| 4,069,630 | 1/1978 | Chess et al. | 52/308 |
| 4,115,953 | 9/1978 | Brosenius | 49/125 |
| 4,121,379 | 10/1978 | Everson | 49/61 |
| 4,160,348 | 7/1979 | Chapman et al. | 52/202 |
| 4,174,596 | 11/1979 | Deibele | 52/202 |
| 4,193,232 | 3/1980 | Almsted et al. | 52/98 |
| 4,215,517 | 8/1980 | Everson | 52/202 |
| 4,221,091 | 9/1980 | Ganse et al. | 52/202 |
| 4,272,934 | 6/1981 | Cowden et al. | 49/61 |

FOREIGN PATENT DOCUMENTS

| | | | |
|---|---|---|---|
| 472225 | 3/1951 | Canada | 49/488 |

*Primary Examiner*—Alfred C. Perham

*Attorney, Agent, or Firm*—Christel, Bean & Linihan

[57] ABSTRACT

A window insulating system including horizontally and vertically arranged channel members positioned in a window wall opening and spaced inwardly of the window surface. Insulating panels are positioned in the channels and can either be opaque fiberglass panels or translucent or transparent panels of glass or plastic. Horizontal channels are secured adjacent the upper edge of the window wall opening and can be secured adjacent the lower edge of the window wall opening or can be above that surface. The vertical channels are frictionally attached to the panel member and the panels plus vertical channels are slipped into the horizontal channels and are thus easily removable for access to the window for maintenance or cleaning purposes. The outer edges of the outermost vertical channels adjacent the vertical window wall opening edges are formed from a resilient material and include an integral, outwardly extending sealing strip which is in sealing engagement with the adjacent window opening edge. The interior vertical channels interfit for ease of installation and removal of the insulating panels and include one channel member which has its outer leg extended to be in overlying relationship to the adjacent vertical channel member.

16 Claims, 16 Drawing Figures

14
2
10
4
33
23
21
19
20
25
52
13
24
6
18
7
9
12
17
26
16
22
5
3
8
11
15

31
32
10
30
27
29
28
14
36
34
33
35
46
47

13
38
44
34
45
33
36
17
15
43
39
35

46
36
47
33
35
34
38
15
42
37
39
11
40
41

45
44
17

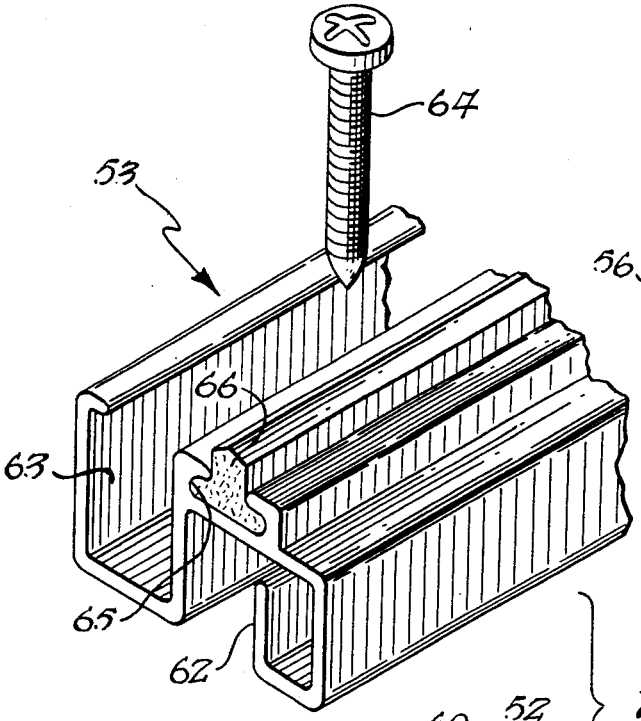
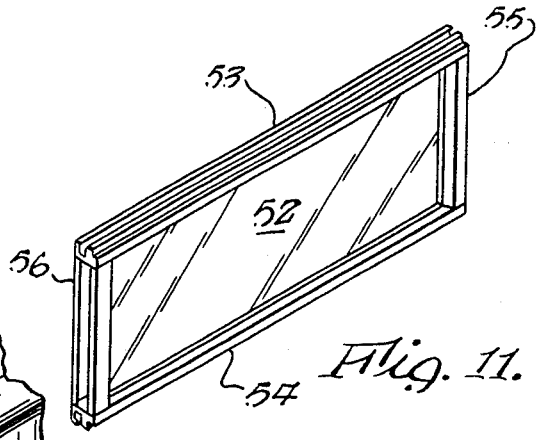
Fig. 11.
Fig. 12.
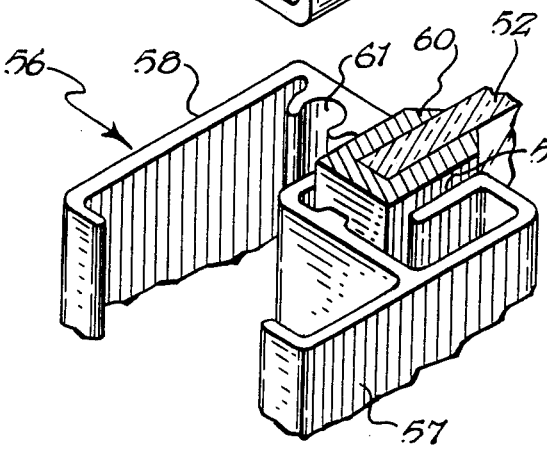
Fig. 13.
Fig. 15.
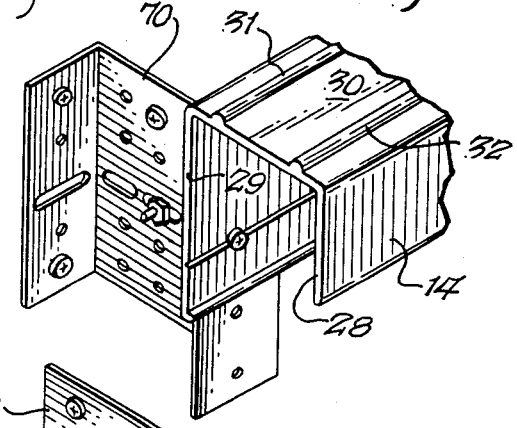
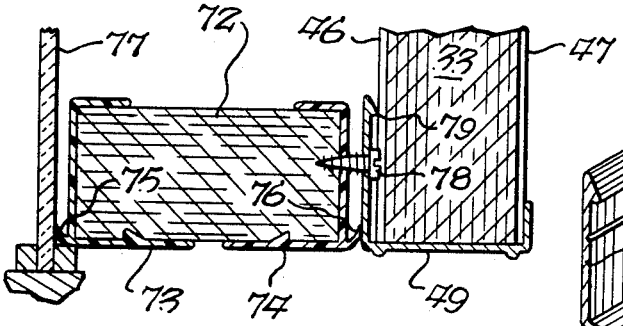
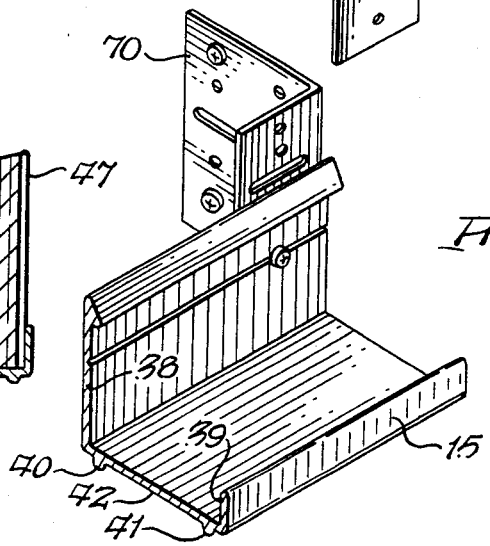
Fig. 14.

WINDOW INSULATING SYSTEM

BACKGROUND OF THE INVENTION

This invention relates to a system for insulating window wall openings, and more particularly to a window insulating system whereby channel-like members are provided in association with the window opening to support one or more insulating panels in spaced relationship to the window.

Within the last several years there have been substantial increases in the cost of energy for heating homes, offices, industrial buildings, and the like. As a consequence, increased emphasis has been placed on energy conservation, both from the standpoint of attempting to preserve and extend the availability of natural resources utilized to provide the necessary energy, and also to reduce the costs involved in providing comfortable interior temperatures in such buildings.

The need for window insulation systems arises from the fact that buildings designed and built prior to the early 1970's were not designed with specific emphasis on minimizing energy usage. As a result, it is not uncommon to find in such buildings rather substantial expanses of window openings, many of which include only single-pane windows, a relatively energy inefficient type of construction. Such large expanses of windows are most often found in industrial buildings, office buildings, and institutional buildings, such as hospitals and schools.

Although it would be possible to provide windows having spaced double panes of glass to provide a dead air space for insulation, that approach would be directed principally to minimizing the loss of heat due to conduction and convection. Such approaches are useful in connection with minimizing winter heating costs, but they do not have as significant an effect upon summer cooling costs since they do not significantly reduce the cooling load within a building caused by the radiant energy of the sun's rays. Additionally, the replacement of windows involves considerable expense, both in terms of costs of the replacement window and the costs to remove the old window and install the new. Therefore, it is desirable to provide a relatively inexpensive insulating system which both reduces the winter heat loss and also reduces the summertime heat gain within the interior of a building, and one which is easier to install, preferably a retrofit of an existing window. It is also desirable to provide a more effective window insulating system than can be obtained by merely providing two spaced panes of glass.

One way in which to significantly reduce winter heat loss and also to provide a barrier to radiant energy heat gain would be to provide opaque insulating panels in spaced relationship to a window and within the window opening. Such an arrangement is disclosed in U.S. Pat. No. 4,221,091. However, the system therein shown and described involves a considerable number of channel-type elements, which require considerable installation time, and consequently, considerable cost.

It is an object of the present invention to provide an improved window insulating system which permits the utilization of opaque insulating panels together with light-transmitting panels which can be arranged in any particular configuration, as desired, and to do so in a relatively simple arrangement which requires fewer parts and less labor than heretofore.

SUMMARY OF THE INVENTION

Briefly stated, in accordance with one aspect of the present invention, there is provided a window insulating system wherein at least one generally rectangularly shaped insulating panel is positioned interiorly of a window wall opening in a building wall. The panel is arranged in spaced relationship to the plane of the window pane and is supported by horizontally and vertically extending channel members. Upper and lower horizontal channel members are positioned adjacent the top and bottom sill surfaces of the window wall opening and each has a generally U-shaped cross section to define an opening in which an edge of an insulating panel can be received. Outer vertical channel members are positioned substantially parallel to the vertical sidewalls of the window wall opening and also are spaced from the plane of the window panes to fit within each of the upper and lower horizontal channel members. The vertical outer channel members are in frictional, gripping engagement with the vertical outer edges of the insulating panel.

BRIEF DESCRIPTION OF THE DRAWINGS

FIG. 11 is a perspective view of a translucent panel together with its surrounding channel members.

FIG. 12 is an enlarged and exploded fragmentary perspective view of the interconnection between a horizontal and a vertical channel member, each of which carries a translucent panel member.

FIG. 13 is a fragmentary cross-sectional view showing the lower edge and channel of an insulating panel and a return panel which serves to close the space between the insulating panel and the window pane in an embodiment where the window insulation system utilized does not extend the full vertical height of the window wall opening.

FIG. 14 is a fragmentary perspective view showing a base channel suspended above the lower portion of the window wall opening.

FIG. 15 is a fragmentary perspective view showing a head channel suspended from a vertical surface.

DESCRIPTION OF THE PREFERRED EMBODIMENTS

Figure 1:
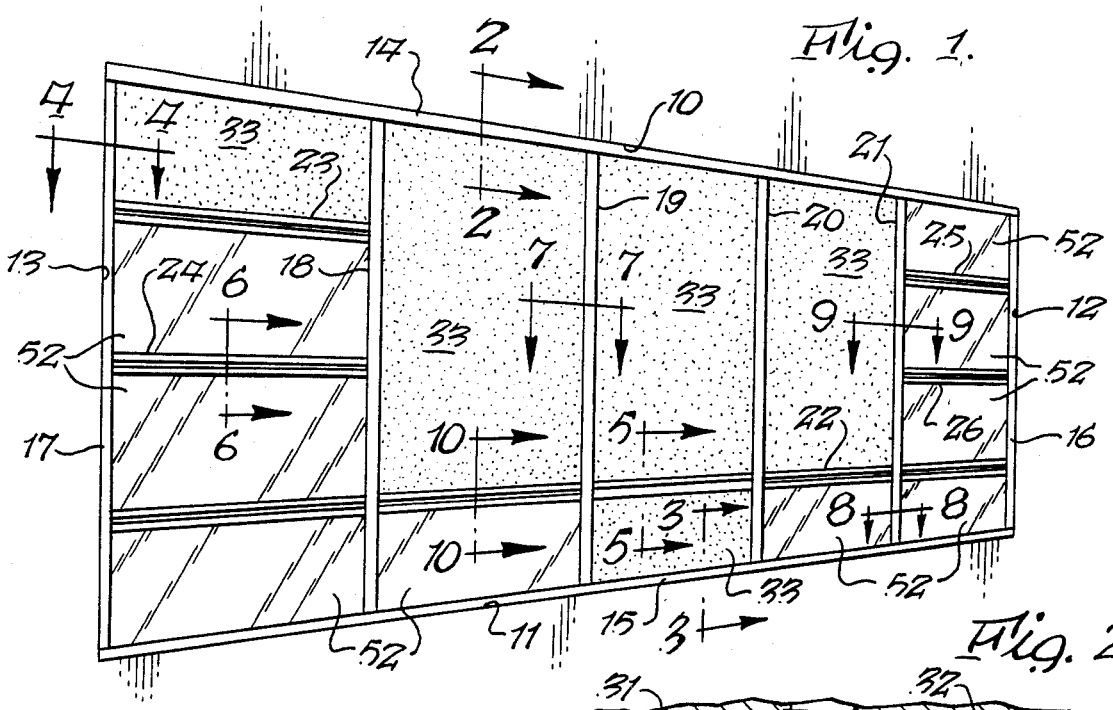
FIG. 1 is an elevational view, in perspective, showing a window insulating arrangement according to the present invention as applied to a multi-panel window wall opening, and including both opaque and translucent rectangular sections.

Referring now to the drawings and particularly to FIG. 1 thereof, there is shown a window insulating system in accordance with the present invention illustrating a plurality of combinations of opaque and translucent panels and their interconnections to form a complete system to be positioned adjacent a window assembly in a window wall opening of a building wall. As used hereinafter, the term "window opening" is intended to refer to such a window wall opening in a building wall.

The window opening is defined by upper and lower horizontal edges 10, 11, respectively, and by right and left side edges 12, 13, respectively. Horizontal members 14, 15 in the forms of channels are provided along upper and lower horizontal surfaces 10, 11 of the window opening, respectively, and vertical channels 16, 17 are provided along each of right and left side edges 16, 17, respectively, of the window opening. Depending upon the size of window opening, and also upon the size panels to be utilized, one or more vertical members can be provided. Similarly, depending upon the height of the window opening, and also depending upon the desired configuration for the light-transmitting and the opaque areas, various intermediate horizontal channels can be provided. As shown in FIG. 1, the window insulating system includes four intermediate vertical joints, 18, 19, 20, and 21, which divide the window opening vertically into five sections. Similarly, one intermediate horizontal joint 22 extends across each of the five vertical sections, and each outermost section, as shown, has two additional horizontal joints 23, 24, 25, 26 to further subdivide those particular sections. Except as otherwise specifically noted, the channel members utilized in connection with the present invention are preferably metallic for rigidity, and they can be of any suitable metals such as aluminum, steel, or the like, and can be decorated as by painting, if desired.

Figure 2:
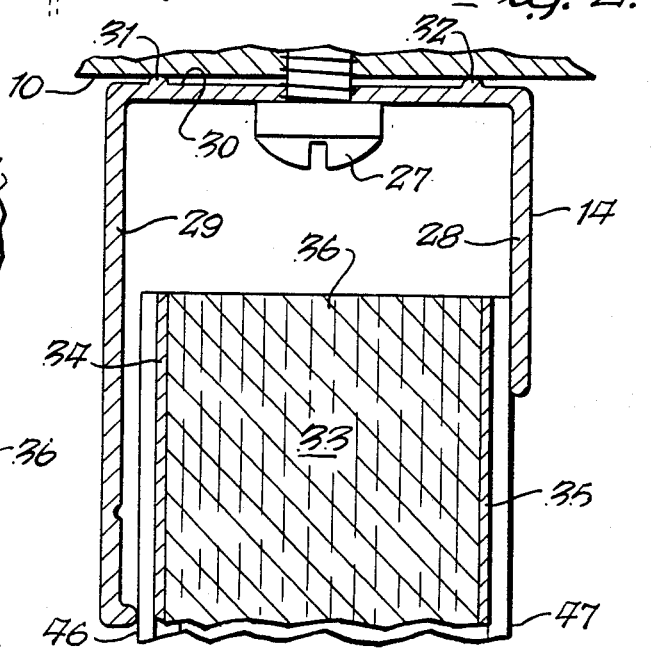
FIG. 2 is a fragmentary cross-sectional view of the upper, panel-supporting channel member and the manner in which is secured to the upper surface of the window wall opening, taken along the line 2—2 of FIG. 1.

Upper horizontal channel member 14 can be secured to upper horizontal surface 10 of the window opening as by means of screws 27 as shown in FIG. 2. The preferred configuration for upper horizontal channel member 14 is an inverted U-shape with the inner leg 28 of the U being somewhat shorter vertically than the outer leg 29. Positioned along upper horizontal surface 30 of the channel member are a pair of spaced longitudinal ridges 31, 32 which are provided to facilitate sealing between channel member 14 and upper horizontal window opening surface 10 to compensate for surface irregularities.

Positioned within channel member 14 and between legs 28, 29 thereof is an insulating panel 33, which includes an outer facing 34 and an inner facing 35 and between which is a core 36 of fiberglass material, preferably having a density of about 6 pounds per cubic foot, although other materials and other densities could also be used, if desired. Outer facing 34 is preferably a facing of white fiberglass cloth or other suitable facing material to provide reflection of heat and light. Inner facing 35 can be a textured white fiberglass cloth and preferably includes an inner aluminum foil vapor barrier (not shown) between the facing and the core. If desired, the vapor barrier can be adjacent outer facing 34, or adjacent both outer facing 34 and inner facing 35. Such a construction can have an "R" value of approximately 8.33. It will be apparent to those skilled in the art that various other types of panel constructions can be employed, but it is preferred that such a fiberglass panel be utilized to provide the desired insulation characteristics.

Figure 3:
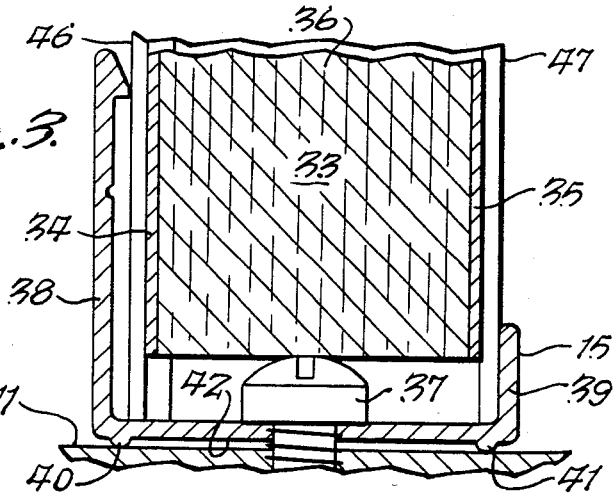
FIG. 3 is a fragmentary cross-sectional view showing the lower horizontal channel member with an insulating panel member therein and also showing the method by which the channel is secured to the lower portion of the window wall opening, taken along the line 3—3 of FIG. 1.

Referring now to FIG. 3, there is shown in cross section lower horizontal channel member 15 and its attachment to lower horizontal edge 11 of the window opening, which attachment can be again, by means of screws 37, or the like. Lower horizontal channel member 15 also is of substantially U-shape with the legs 38, 39 of the U of unequal length to permit removal of the panels, as desired, for maintenance or window cleaning purposes. Outer leg 38 and inner leg 39 of lower horizontal channel 15 are shorter than the corresponding inner and outer legs 28, 29 of upper channel 14 since the panels extend substantially to the tops of screw 37. Lower horizontal channel 15 also includes a pair of spaced longitudinal ridges 40, 41 extending from the lowermost outer surface 42 thereof to provide sealing contact with lower horizontal surface 11 of the window opening and thereby provide a substantially airtight seal regardless of minor surface irregularities in lower horizontal surface 11.

Figure 4:
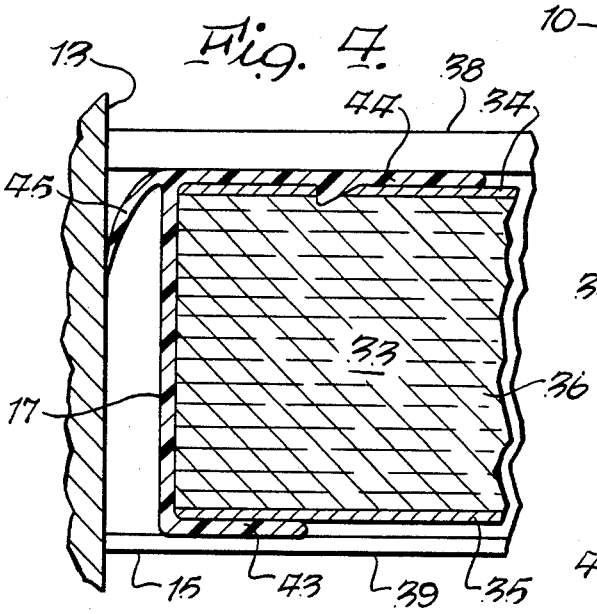
FIG. 4 is a fragmentary cross-sectional view of a vertical edge channel member showing its positioning with respect to the vertical side surface of the window wall opening, taken along the line 4—4 of FIG. 1.
Figure 4A:
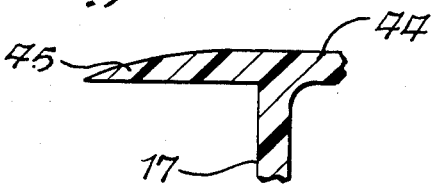
FIG. 4*a* is a fragmentary view of the outer edge portion of the vertical channel member shown in FIG. 4 and showing the orientation of the sealing lip thereof prior to the installation of the channel against the side of the window wall opening.

As shown in FIG. 4, positioned vertically adjacent left vertical window opening surface 13 is a vertical channel member 17 which is of substantially U-shape and the inner and outer legs of which 43, 44, respectively, can have unequal lengths. Preferably, vertical outer channel member 17 is formed of a flexible material, such as, for example, polyvinyl chloride, in order that an integral sealing strip 45 can be provided. Sealing strip 45 extends from outer leg 44 of channel member 17 and bears against the associated vertical surface 13 of the window opening. As shown in FIG. 4, sealing strip 45 is in its deflected, operation position wherein it bears against inner surface 13 of the window opening. As formed, sealing strip 45 preferably extends outwardly as shown in FIG. 4*a* so that when installed it will be deflected and in continually attempting to regain its undeflected position, it provides the desired seal. Preferably, vertical end channel 17 is not secured to window edge 13 and is supported with its legs 43, 44 bearing against inner and outer legs 28, 29 of upper horizontal member 14 at its upper junction thereof and with respective inner and outer walls 39, 38 of lower channel member 15 at its lower junction thereof.

The foregoing describes the basic outer framing for a window insulating system of the present invention. If a single insulating panel is sufficient to provide the full coverage for the particular window opening involved, the panel is provided in the form of a rectangular element which has a horizontal dimension which is slightly less than the horizontal width of the window opening and has a vertical dimension which is also slightly less than the vertical window opening in order to facilitate installation and removal. Installation can be accomplished by attaching the flexible vertical edge channel members to the vertical outer edges of the panel, sliding the panel with the vertical edge members in place up into the upper horizontal channel member until it is in contact with screws 27, then urging the lower edge of the panel inwardly until outer surface 34 is in contact with outer leg 38 of lower channel 15, whereupon the panel will slide into the lower channel 15 until it is seated. When seated the uppermost edge thereof will be positioned above the lower edge of inner leg 28 of upper channel 14, as shown in FIGS. 2 and 3.

When the windows which are desired to be insulated are of substantial height, or of substantial width, additional panel openings will, of necessity, have to be provided. Additionally, if both opaque panels and translucent panels are desired, intermediate channel members will have to be added to define the extent of those particular types of panels. As used herein, the term "translucent" is intended to include panels which are capable of admitting light therethrough, and can also include transparent panels, according to the preferences of the user of such window insulating systems.

Figure 7:
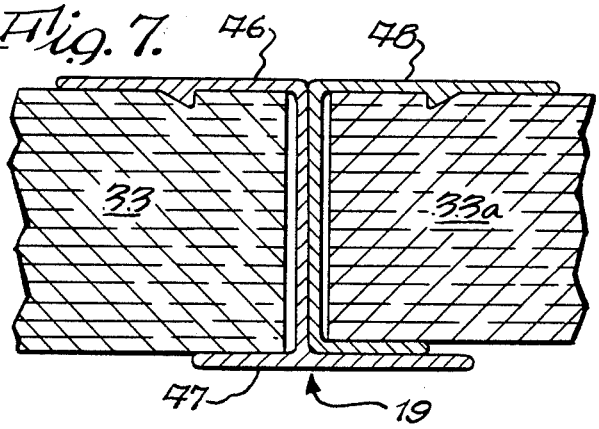
FIG. 7 is a fragmentary cross-sectional view showing the relative position of intermediate vertical channel members having insulating panels positioned therein, taken along the line 7—7 of FIG. 1.

When vertical division of the window opening is desired or required, an intermediate vertical joint 19 must be provided at the intersections of adjacent opaque panels. As shown in FIG. 7, the structure of joint 19 includes a channel member 46 which is substantially U-shaped and is so sized that the internal surfaces of the legs of the U embrace panel 33, the leg facing outermost including an extended flange portion 47. Adjacent panel 33*a* also includes a substantially U-shaped channel 48 to receive and embrace the outer edge of the panel, the channel being adapted to fit against channel member 46 of adjacent panel 33 with the extended flange 47 covering the abutting surface of channel 48. Vertical intermediate channel members 46, 48 are not secured to one another but interfit as shown in FIG. 7. In multiple vertical joint installations, involving wide window wall openings, alternating panels will include either channels 46 or 48 along their vertical edges. Thus, if a panel includes channels 46 at each vertical edge, the adjacent panels on either side will include channels 48 along their vertical edges to permit the interfitting shown and described, which facilitates panel removal for purposes of access. The outermost vertical edges of the outermost panels will have channel 17 shown in FIG. 4 to provide the desired sealing effect.

Figure 5:
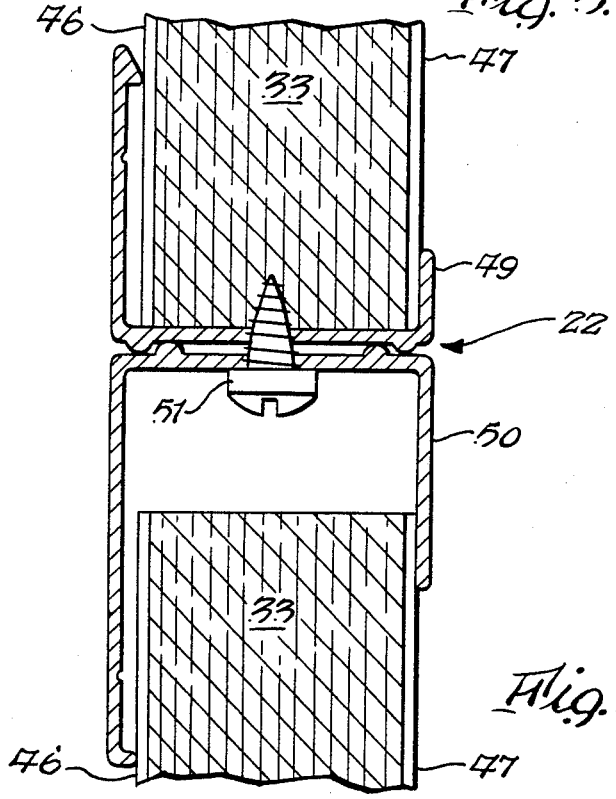
FIG. 5 is a fragmentary cross-sectional view showing the interconnection of a pair of horizontally extending channel members, each of which includes an insulating panel, taken along the line 5—5 of FIG. 1.

In those instances where additional horizontal members are necessary or desired, the horizontal joint 22 can be provided by back-to-back channel members. As shown in FIG. 5, the upwardly facing channel 49 can be substantially identical to lower horizontal channel 15 which is secured to lower horizontal edge 11 of the window opening. Similarly, the downwardly facing channel 50 can be of the same shape and size as upper horizontal channel 14 which is secured to upper horizontal edge 10 of the window opening. Preferably, the two channel members defining intermediate horizontal joint 22 are secured together as by means of screws 51.

If it is desired to provide at least one translucent panel in the window insulating system, similar vertical channel members are employed as for an opaque panel. The general form of such a translucent panel is illustrated in FIG. 11, which shows a sheet 52 of translucent or transparent material, which can be an ordinary glass window pane, plastic sheet or the like, as desired, and which includes horizontal channel members 53, 54 and vertical channel members 55, 56 which enclose sheet 52. As shown, horizontal channels 53, 54 overlap the ends of vertical channels 55, 56. The combination of horizontal and vertical channels provides a rigid framework for sheet 52.

The interconnection of the horizontal and vertical channel members is shown in FIG. 12, which also shows the respective cross sections for each of those channels. As shown, vertical channel member 56 includes a flat, inwardly facing side 57 and a flat, outwardly facing side 58 between which is positioned a relatively narrow, sheet-receiving channel 59, which is substantially parallel with inner and outer sides 58, 59. Channel 59 is of generally U-shape and is sized to receive sheet 52 and an associated insulating strip 60, which can be, for example, an extruded vinyl channel which is positioned over the outer edges of sheet 52. Spaced between channel 59 and outer face 58 is a screw-receiving socket 61, which can be formed integrally with vertical channel 56. Upper horizontal channel 53 is shown positioned above vertical channel 56 and includes a downwardly facing, substantially U-shaped channel 62 to receive sheet 52 and its associated insulating strip 60. An upwardly facing channel 63 is positioned adjacent and spaced outwardly from downwardly facing channel 62 and a screw 64 is provided to permit interconnection between horizontal channel 53 and vertical channel 57, the screw passing through the base of upwardly facing channel 63 and received in socket 61 in vertical channel 56. Similar connections are made at the remaining three edges of sheet 52. Horizontal channels 53 and 54 include a slot 65 adapted to receive a sealing strip 66.

Figure 10:
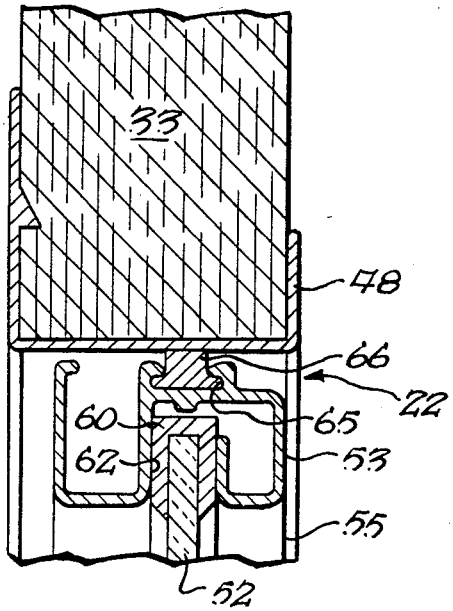
FIG. 10 is a fragmentary cross-sectional view showing the horizontal joint between a channel member carrying a translucent panel, taken along the line 10—10 of FIG. 1.

A horizontal joint between an opaque panel and a translucent panel is shown in FIG. 10. In the configuration shown the opaque panel is uppermost and sealing strip 66 is in sealing engagement with the lower surface of horizontal channel 48.

Figure 9:
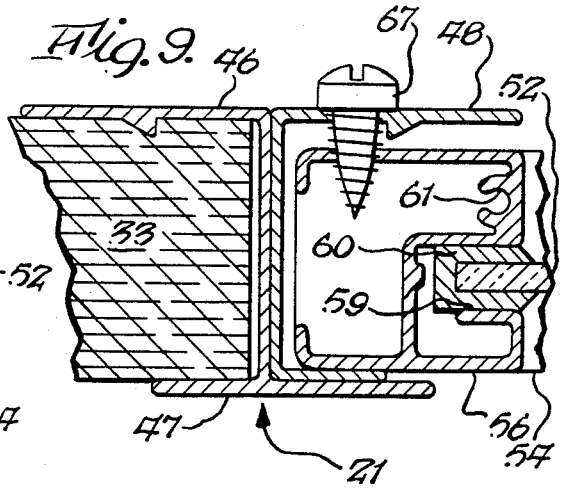
FIG. 9 is a fragmentary cross-sectional view showing the relative position of intermediate vertical channel members wherein one channel is attached to an insulating panel and the other channel has a translucent panel member positioned therein, taken along the line 9—9 of FIG. 1.

The vertical arrangement of the transparent panel interconnection with an opaque panel is shown in FIG. 9. As there shown, vertical channel 56 associated with sheet 52 is secured to U-shaped channel 48 of the type utilized in connection with an opaque panel. The respective channels are secured by means of screws 67. Thus vertical channel 56 associated with sheet 52 includes an outer channel 48 secured thereto for cooperative engagement with the mounting system, while horizontal channel member 53 for sheet 52 does not utilize such an additional channel member.

Figure 6:
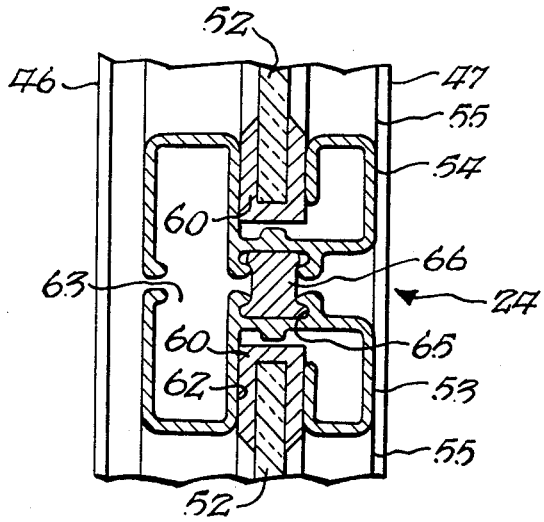
FIG. 6 is a fragmentary cross-sectional view showing the horizontal interconnection between a pair of channel members adapted to carry light transmitting panels, taken along the line 6—6 of FIG. 1.
Figure 8:
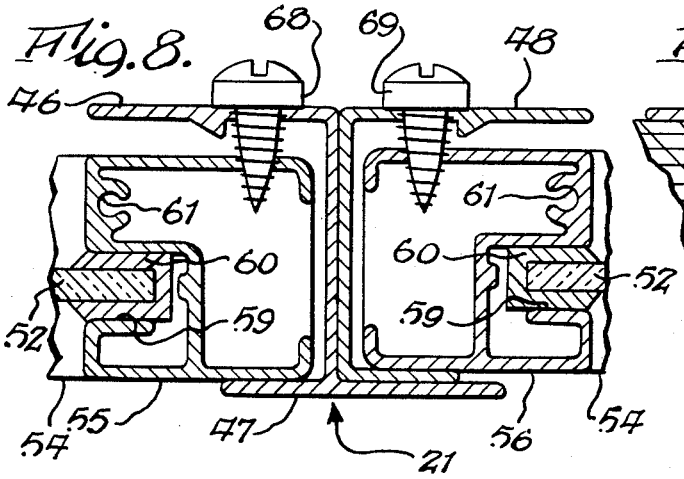
FIG. 8 is a fragmentary cross-sectional view showing the interconnection of two vertical channel members which carry translucent panels, taken along the line 8—8 of FIG. 1.

In those installations where a pair of translucent panels are positioned vertically one above the other, the contacting arrangement of the respective upper and lower surfaces of the adjacent channels 53, 54 is as shown in FIG. 6. As shown, there is no rigid interconnection between the horizontal channels, there being but a sealing engagement provided by sealing strip 66, which can be carried in either of channels 53 or 54, and which provides a horizontal seal therebetween.

Where horizontally adjacent panels are formed from translucent panel elements, the interconnection and vertical arrangement are as shown in FIG. 8. Each of vertical channel members 55, 56 is secured to an auxiliary channel member 46, 48, respectively, of the same type as is utilized with opaque panels. The auxiliary channels are secured to the transparent panel channels by means of screws 68, 69.

When the horizontal channel members are of insufficient length and must be connected to adjacent horizontal channel members, a pair of such channels can be butted together in end-to-end relationship and a splicing plate (not shown) can be secured to each of the abutting channel members, as by means of screws, as would be apparent to those skilled in the art.

If it is desired to provide the window insulating system according to the present invention in only a portion of a window opening, and some uncovered vertical space is desired between the lower edge of the system and the lower surface of the window opening, an arrangement such as shown in FIG. 13 can be employed to provide the necessary dead air space for maximum insulation value. As shown, an intermediate return or spacer panel 72 is provided, and channel members 73, 74 having a cross section similar to that for the vertical outer channel members are provided and are adapted to be mounted on the inner and outer surface thereof. Sealing strips 75, 76 of the channel members bear against the window surface 77 and the adjacent surface of horizontal channel 49 to provide sealing engagement therewith channel members 74 and 49 are secured together as by means of screws 78.

Both the horizontal and the vertical channel members utilized with the opaque insulating panels include an inwardly extending longitudinal ridge (such as ridge 79 in FIG. 13), the purpose of which is to bear against the outer panel surface with which it is associated and thereby assure a firm frictional connection between the channel and the panel.

In those installations where the lower portion of the window wall opening is to remain uncovered it is necessary to suspend the lower horizontal channel above the lower horizontal edge of the window wall opening. As shown in FIG. 14, lower horizontal channel 15 is secured to an angle bracket 70, which, in turn, can be secured to the side vertical surface (not shown) of the window wall opening. Similarly, where it is either necessary or where it is desired that the upper horizontal channel not be secured to the upper horizontal surface of the window wall opening, a similar arrangement utilizing angle bracket 70 could be employed for that channel. Additionally, should it be desired to suspend either the upper horizontal channel or the lower horizontal channel from the window frame itself, or from another surface parallel to the window surface, a pair of angle brackets 70 could be utilized by connecting them to form a U as shown in FIG. 15, securing the rearmost angle bracket to the desired surface and the forwardmost angle bracket to the channel member, such as upper horizontal channel 14 as shown.

It can thus be seen that the present invention as shown and described provides an improved window insulating system which requires a minimum of parts and which provides a maximum of flexibility in terms of the provision of opaque and transparent or translucent panels.

While particular embodiments of the present invention have been shown and described, it will be apparent to those skilled in the art that various changes and modifications can be made, and it is intended to cover in the appended claims all such changes and modifications that are within the scope of the present invention.

What is claimed is:

1. A window insulating system capable of being assembled to cover a window assembly mounted within a window wall opening in a building wall, said opening being defined by horizontally extending top and bottom surfaces and vertically extending side surfaces, each of said top, bottom and side surfaces, extending inwardly of said opening; said system when assembled including:

at least one generally rectangular insulating panel having inner and outer faces, upper, lower and opposite side edges, and an intermediate core of insulating material;

vertical channel members having a generally U-shaped cross section and normally adapted to be positioned on the opposite side edges of the insulating panel and in gripping engagement with the inner and outer faces of the insulating panel; and upper and lower horizontal channel members adapted to be mounted on the horizontally extending top and bottom surfaces, each of said horizontal channel members having a generally U-shaped cross section defining an opening in which an edge of an insulating panel is adapted to be removably received, and including inner and outer legs with said outer legs adapted to be disposed closest to said window assembly;

the parts being so arranged and constructed that when the system is assembled an insulating panel is removably positioned adjacent to but spaced from the interior side of the window assembly and has its lower edge resting within said horizontal lower channel member and its upper edge within said upper horizontal channel member, and the vertical channel members are supported by said opposite side edges and are disposed adjacent the side surfaces of said window wall opening.

2. A window insulating system capable of being assembled to cover at least in part a window assembly mounted within a window wall opening in a building wall, said opening being defined by horizontally extending top and bottom surfaces and vertically extending side surfaces, each of said surfaces extending inwardly of said opening; said system when assembled including:

at least one generally rectangular insulating panel having inner and outer faces, and upper, lower, and opposite side edges;

vertical channel members having a generally U-shaped cross section, said vertical channel members normally being adapted to be positioned on opposite side edges of the insulating panel and in gripping engagement with the panel's inner and outer faces;

an upper horizontal channel member adapted to be mounted on the top surface, said upper horizontal channel member having a generally U-shaped cross section defining an opening in which an upper edge of an insulating panel is adapted to be removably received and including inner and outer legs with said outer legs being adapted to be disposed closest to the window assembly;

a lower horizontal channel member adapted to be spaced below and parallel to said upper horizontal channel member, said lower horizontal member having a generally U-shaped cross section defining an opening in which an edge of an insulating panel is adapted to be removably secured, and including inner and outer legs with said outer legs being adapted to be disposed closest to the window assembly;

a spacer panel adapted to be positioned adjacent the lower horizontal channel member and to extend substantially horizontally between said window assembly and the outer leg of said lower horizontal channel member, said spacer panel having inner and outer edges;

inner and outer peripheral channel members adapted to be disposed about the inner and outer edges of the spacer panel, respectively, the peripheral channel member which is adapted to be disposed about the inner edge of the spacer panel also being adapted to be secured to said lower horizontal channel member, and the peripheral channel member which is adapted to be disposed about the outer edge of the spacer panel also being adapted to be supported by said window assembly;

the parts being so arranged and constructed that when the system is assembled an insulating panel is removably positioned adjacent to but spaced from the interior side of the window assembly and has its lower edge resting within said horizontal lower channel member and its upper edge within said upper horizontal channel member, and the vertical channel members are supported by said opposite side edges and are disposed adjacent the side surfaces of said window wall opening.

3. The window insulating system of claim 2 wherein the peripheral channel member adapted to be carried by the outer edge of the spacer panel includes an outwardly extending sealing lip adapted to be disposed in sealing engagement with said window assembly.

4. The window insulating system of claim 1 or 2 wherein the inner and outer legs of said upper horizontal channel member are longer than the respective inner and outer legs of said lower horizontal channel member.

5. The window insulating system of claim 4 wherein said outer legs of each of said upper and lower horizontal channel members include a longitudinal, inwardly facing ridge adapted to urge the inner face of said insulating panel into closely fitting engagement with said inner legs.

6. The window insulating system of claim 1 or 2 wherein said vertical channel members are formed from a resilient material and are adapted to be in closely fitting engagement with said side edges of said insulating panel.

7. The window insulating system of claim 6 wherein said outer legs of said vertical channel members include a longitudinal, inwardly extending ridge adapted to urge the inner face of said insulation panel into closely fitting engagement with said inner legs of said vertical channel members.

8. The window insulating system of claim 6 wherein said vertical channel members include a resilient, outwardly extending sealing strip.

9. The window insulating system of claim 1 or 2 wherein said system further includes a plurality of generally coplanar, vertically arranged rectangular panel sections, and a pair of generally U-shaped channel members placed back-to-back with one of said channel members facing upwardly and the other facing downwardly, said upwardly facing channel member having shorter legs than said downwardly facing channel member, each of said channel members being adapted to receive and hold a horizontal edge of a panel member.

10. The window insulating system of claim 1 or 2 wherein said system includes a plurality of generally coplanar, horizontally arranged rectangular panel sections having adjacent vertical edges separated by a pair of generally U-shaped vertical intermediate channel members having spaced legs adapted to be in frictional engagement with the inner and outer faces of said insulating panels, said channel members being positioned in back-to-back relationship.

11. The window insulating system of claim 10 wherein the outermost leg of one of said vertical intermediate channel members includes a flange which extends from and is coplanar with said outermost leg and overlies the outermost leg of said adjacent vertical intermediate channel.

12. The window insulating system of claim 11 wherein at least one of said panels is translucent, said translucent panel being adapted to be supported in a frame which is adapted to be in sealing engagement with the periphery of said translucent panel, said frame including horizontal members and vertical members, said horizontal frame members including an outwardly extending sealing strip of resilient material, and said vertical frame members including vertical intermediate channel members secured thereto.

13. The window insulating system of claim 12 wherein said upper horizontal channel member is adapted to be secured to the upper horizontal surface of said window wall opening.

14. The window insulating system of claim 12 wherein said upper horizontal channel member is adapted to be secured to a bracket secured to a vertical surface within said window wall opening.

15. The window insulating system of claim 14 wherein said lower horizontal channel member is secured to the vertically extending side surfaces of said window wall opening.

16. The window insulating system of claim 13 wherein said lower horizontal channel member is adapted to be secured to the vertically extending side surfaces of said window wall opening.

* * * * *